United States Patent [19]

Bieber et al.

[11] 4,226,080

[45] Oct. 7, 1980

[54] LOADING DEVICE FOR FALSE-TWIST APPARATUS

[75] Inventors: Theo Bieber; Friedrich Schuster; Günther Paul; Günther Schmitt; Wolfgang Schmucker, all of Hammelburg, Fed. Rep. of Germany

[73] Assignee: Kugelfischer Georg Schafer, & Co.

[21] Appl. No.: 43,847

[22] Filed: May 30, 1979

[30] Foreign Application Priority Data

Jun. 1, 1978 [DE] Fed. Rep. of Germany ..... 2824034

[51] Int. Cl.[3] ..... D01H 7/92; D01H 13/04

[52] U.S. Cl. ..... 57/339; 57/352; 57/280

[58] Field of Search ..... 57/338, 339, 343, 352, 57/279, 280

[56] References Cited

U.S. PATENT DOCUMENTS

| | | | |
|---|---|---|---|
| 3,287,890 | 11/1966 | McIntosh et al. | 57/339 |
| 3,854,276 | 12/1974 | Marzoli | 57/339 |
| 3,911,661 | 10/1975 | Naylor | 57/339 |
| 3,942,313 | 3/1976 | Gassner et al. | 57/339 |
| 4,027,467 | 6/1977 | Smith | 57/352 X |
| 4,149,366 | 4/1979 | Bass et al. | 57/339 X |

*Primary Examiner*—Donald Watkins
*Attorney, Agent, or Firm*—Karl F. Ross

[57] ABSTRACT

A false-twist apparatus has a support defining three generally parallel and radially spaced axes surrounding a central axially extending twisting region. Respective shafts are journaled in this support for rotation about the axes and carry respective staggered sets of axially spaced disks whose rims radially overlap at the twisting region. Yarn eyes above and below the sets of disks are axially aligned with this twisting region so that a yarn to be false-twisted can pass axially through the lower eye, then zigzag along the regions in contact with the disks, and then pass axially out through the other eye. All of the disks are permanently joined and synchronously rotated. A holder displaceable in a straight line on the apparatus support carries a plurality of arms having yarn-pushing tips that can push a yarn to be false-twisted radially into the region. The straight-line motion of the loading arms as well as their axial positions holds the yarn being loaded in out of contact with the outwardly traveling rims of one of the sets of disks while pressing it against the inwardly traveling rims of the adjacent set of disks.

18 Claims, 9 Drawing Figures

LOADING DEVICE FOR FALSE-TWIST APPARATUS

FIELD OF THE INVENTION

The present invention relates to a false-twist apparatus. More particularly this invention concerns a loading device for threading a yarn through a disk-type false-twist apparatus.

BACKGROUND OF THE INVENTION

A disk-type apparatus has a support defining three generally parallel and equispaced axes surrounding a central axially extending twisting region. Respective shafts lie on these axes and are journaled in the support for rotation about the respective axes. Each shaft carries a respective set of axially spaced disks. The disks of each set are offset from the disks of the other sets so that the rims of these disks can radially overlap at the twisting region. A pair of yarn eyes axially flanks the sets of disks in axial alignment with the thread-twisting region. Thus a yarn to be false-twisted can pass axially through one of the eyes, then axially along the twisting region in contact with the disks, and then axially through the other eye. During the false-twisting operation the disks are all synchronously rotated in the same angular direction so that their rims in contact with the yarn impart a false twist to it. Such an arrangement has proven itself extremely practical and effective.

Threading the yarn to be false twisted through such an apparatus is a relatively complex operation, as the yarn passes in a zigzag through the thread-twisting region while contacting each of the disks. Just pushing the yarn into the nip between two of the sets of disks is ineffective, as at such a nip the rims of one of the sets will be moving outwardly while the others will be moving inwardly, so that forcing the yarn inwardly in this manner is impossible.

Accordingly recourse has been had to a system such as described in U.S. Pat. No. 3,911,661 of Oct. 14, 1975. In this arrangement the disks are spaced relatively far apart axially and a threading device is provided having a plurality of arms that extend into the thread-twisting region adjacent the shaft of one of the sets of disks. These arms are positioned so that they hold a filament against the inwardly traveling rims of one set of disks while holding it out of contact with the adjacent outwardly traveling rims. This arrangement has two principal disadvantages. First, it requires the apparatus to be relatively tall, as considerable axial spacing is needed between the disks to allow the device to function by holding the filament out of contact with the outwardly traveling rims. Second, such an arrangement brings the yarn which is at a standstill into contact at a single instant with a plurality of traveling rims, while at the same time forcing the yarn to move from a straight path to a zigzag path. This abrupt change in speed and path frequently breaks the yarn.

German printed Pat. applications Nos. 2,606,198 and 2,607,290 show another system wherein the eyes axially flanking the sets of disks are displaceable between an inner position axially alligned with the twisting region and an outer position spaced outwardly therefrom. The device employs separate electrical motors for synchronously driving the respective shafts carrying the sets of disks. To load a yarn into the device the eyes are swung outwardly and a yarn is threaded through them along the edge of the apparatus. Then the yarn is moved inwardly between the nip of two sets of disks to a position extending along the twisting region. During this loading operation the set of disks that would have the outwardly traveling rims is arrested so that only the inwardly traveling rims are effective on the yarn being loaded in to displace it into the desired position. Although such a device does allow the vertical height of the arrangement to be reduced considerably over that of the above-described U.S. patent, it requires expensive separate drives for the various shafts, along with appropriate control equipment. Furthermore, the yarn is again brought from a standstill into engagement with the inwardly-moving rims which immediately deform it into a zigzag path, so that the likelihood of breakage with this relatively complex device is just as great as with the other above-described prior-art system.

OBJECTS OF THE INVENTION

It is therefore an object of the present invention to provide an improved loading device for a false-twist apparatus of the disk type.

Another object is to provide such a device which is relatively simple and compact.

A further object is to provide such a device which can be moved from one false-twist apparatus to another.

A yet further object of the present invention is to provide a loading device which largely eliminates the above-described likelihood of yarn breakage.

SUMMARY OF THE INVENTION

These objects are attained according to the instant invention in a false-twist apparatus of the above-described general type and provided with a holder displaceable in a substantially straight line generally perpendicular to the twisting region toward and away from this region and carrying at least one loading arm that has a thread-pushing tip turned toward the region and engageable between the disks. Normally the number of arms provided is equal to the number of disks in one of the sets of disks. The tips are displaceable with the respective arms between an outer position spaced from the disks and an inner position with the tips and the yarn engaged thereover in the twisting region.

The loading arms therefore can push a filament into the twisting region while holding it out of contact with the outwardly traveling peripheries of the one set of disks, and maintaining it in contact with the inwardly traveling peripheries of the other set of disks. Thus a relatively simple piece of equipment can load a yarn into a false-twist device in a simple operation. Normally the user pulls the holder all the way out so as to thread a new yarn through the upper and lower eyes that are advantageously carried thereon, then simply pushes it into the false-twist apparatus, while it is running, to load it. In accordance with this invention all of the sets of disks are permanently connected together for synchronous rotation. There is no need to provide a separate drive for each set of disks or a releasable clutch on one of the sets of disks.

According to further features of this invention the holder is formed with an S-shaped slot that is engaged by a pin projecting upwardly from the support. This slot has a straight section corresponding to the straight line of displacement of the holder. At one end the slot is enlarged so that the holder can be lifted off the false-twist apparatus for use on another false-twist apparatus. Thus it is possible for the loading device to be moved from apparatus to apparatus, greatly reducing equipment costs.

According to another feature of this invention the tips are offset stepwise away from the twisting region. Thus a yarn being loaded into the apparatus is moved incrementally into contact with the disks so that the twisting and acceleration increases incrementally, rather than starting all at once as in the prior-art device. Thus the likelihood of thread breakage is greatly reduced.

SPECIFIC DESCRIPTION

Figure 1:
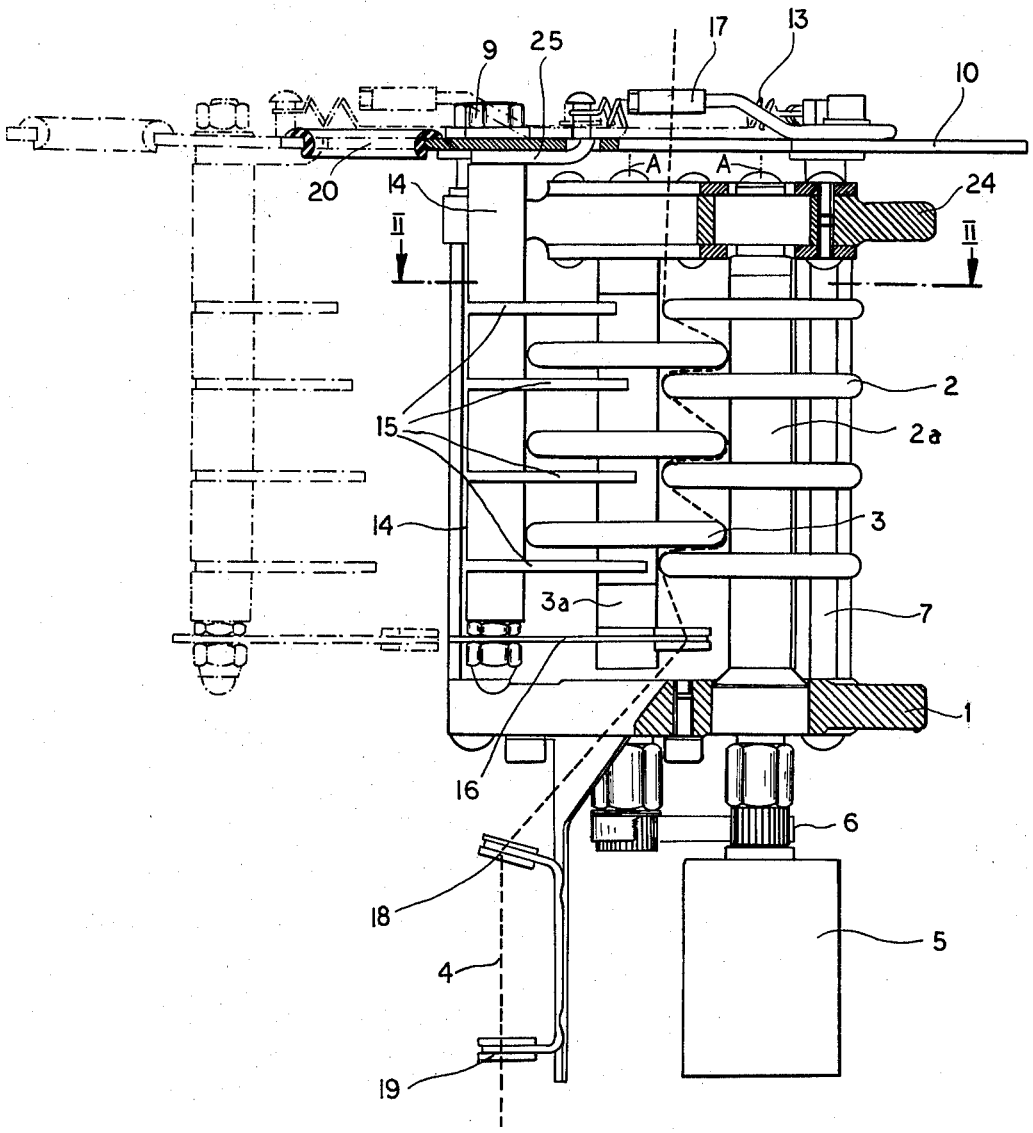
FIG. 1 is a vertical section through the apparatus according to this invention.
Figure 2:
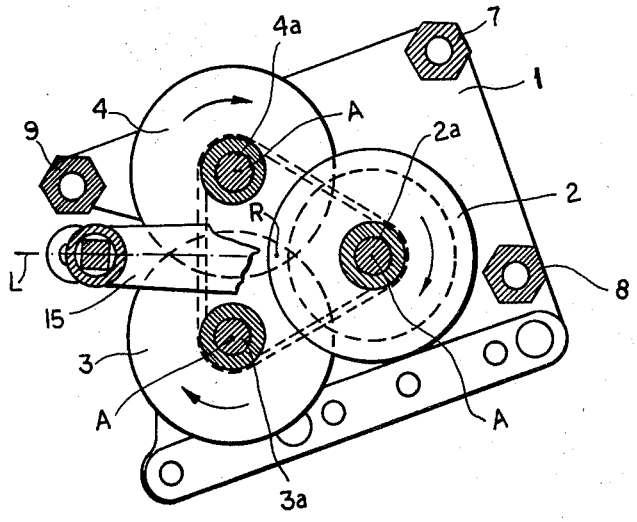
FIGS. 2 and 3 are sections taken along line II—II of FIG. 1 showing the loading devices respectively in the inner and outer positions.

As seen in FIGS. 1–5 a false-twist apparatus according to the invention has a lower support plate 1 secured via tie bolts 7,8 and 9 to an upper support plate 24. Three parallel shafts 2*a*, 3*a* and 4*a* defining parallel axes A are journaled in these plates 1 and 24 carry respective sets of identical disks 2,3 and 4. A reversible electric drive motor 5 is connected to the shaft 2*a* and via a toothed belt 6 to the shafts 3*a* and 4*a* for synchronous codirectional rotation of the sets of disks 2–4. As seen in FIG. 2 the disks 2–4 define respective imaginary cylinders that overlap at a small generally triangular central region R equispaced between the axes A. False twisting takes place in the known manner in this region R.

A loading device has a holder plate 10 formed with a throughgoing S-shaped slot 11 through which extends the upper end of the tie rod 9 having a nut forming an enlarged head that guides the elongated plate 10 on the false-twist apparatus. In addition this plate 10 has a pair of parallel edges 10*a* and 10*b* guided on the tie bolts 7 and 8 for straight-line displacement of this plate 10 in the direction indicated by line L in FIG. 2.

The holder plate 10 carries a downwardly extending rod 14 defining an axis A′ and fitting inside a sleeve 14*a* carrying a plurality of substantially identical arms 15 differing only in length, and extending in the direction of line L. Each of these arms 15 is aligned at the axial level of one of the disks 2 and has a tip with a pair of pusher surfaces 21 flanking a central point 23 and each ending in an end hook 22. One of these pusher surfaces 21 is generally S-shaped and extends at an angle smaller than 45° to the line L and the other is generally U-shaped and extends at an angle of greater than 45° to the line L. As FIGS. 1 and 3 both plainly indicate the tips of the arms 15 are offset stepwise back from the region R from the bottom up.

In addition, the support plate 10 carries an upper eye 17 aligned with the region R in the inner position of the device, and axially aligned thereunder with an eye 16 carried on the lower end of the central rod 14. A tension spring 13 is hooked between the plate 10 and the upper end of the tie bolt 7 and normally pulls the holder 10 to the inner (solid line) position. The plate 20 also has a large finger hole 20 provided with a grommet and allowing easy pulling of the plate 10 for reloading. Below the eye 16 the support 1 is provided with two further eyes 18 and 19.

Figure 3:
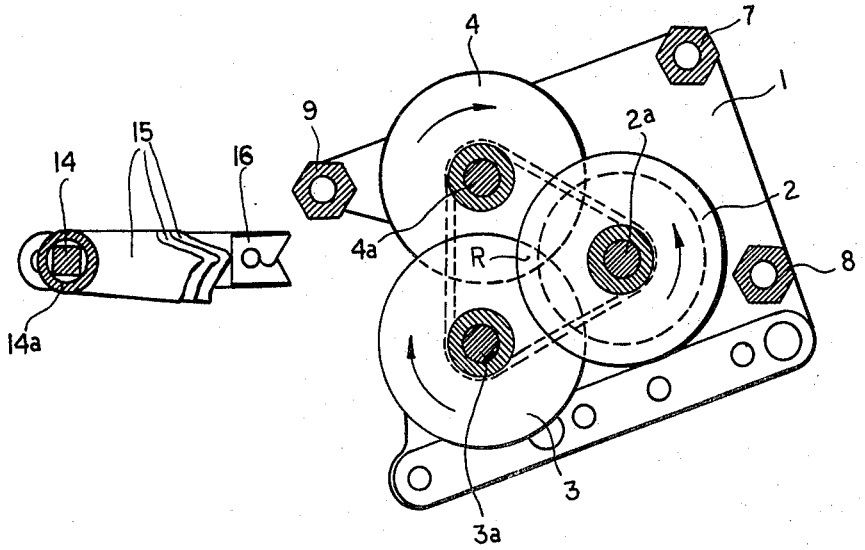

In use the motor 5 normally runs continuously. When it is necessary to thread a new yarn Y through the machine the holder plate 10 is gripped and pulled outwardly into the dot-dash outer position of FIG. 1. The new yarn Y is then threaded up through the eyes 19 and 18, then through the superposed eyes 16 and 17. Thereafter the holder plate 10 is displaced radially inwardly, toward the axis A of the shaft 2*a*, so as to push the yarn Y into the region R. During such loading the yarn Y is held out of contact with the outwardly-traveling rims of the disks 4 as seen in FIGS. 2 and 3 while being pressed against the inwardly-traveling rims of the disks 3.

In the event that the yarn Y is to be twisted in the opposite direction, that is from a S- to a Z-twist or vice versa, it is merely necessary to pivot the outer tube 14*a* slightly. This is effected by displacing an abutment tab 25 from one side to the other of a recess 26 and then reclamping the tube 14*a* on the rod 14. The arms 15 shown in FIG. 5 can be used in both such situations, due to the provision of two pusher surfaces 21 and end hooks 22.

Figure 9:
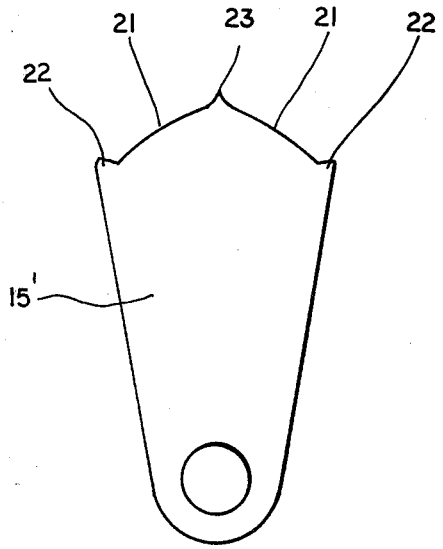
FIG. 9 is a top view of another loading arm according to the present invention.

FIG. 9 shows an arm 15′ that is symmetrical about its longitudinal axis. The two pusher surfaces 21 here run at an angle of approximately 40° to the longitudinal axis of the respective arm 15.

Figure 4:
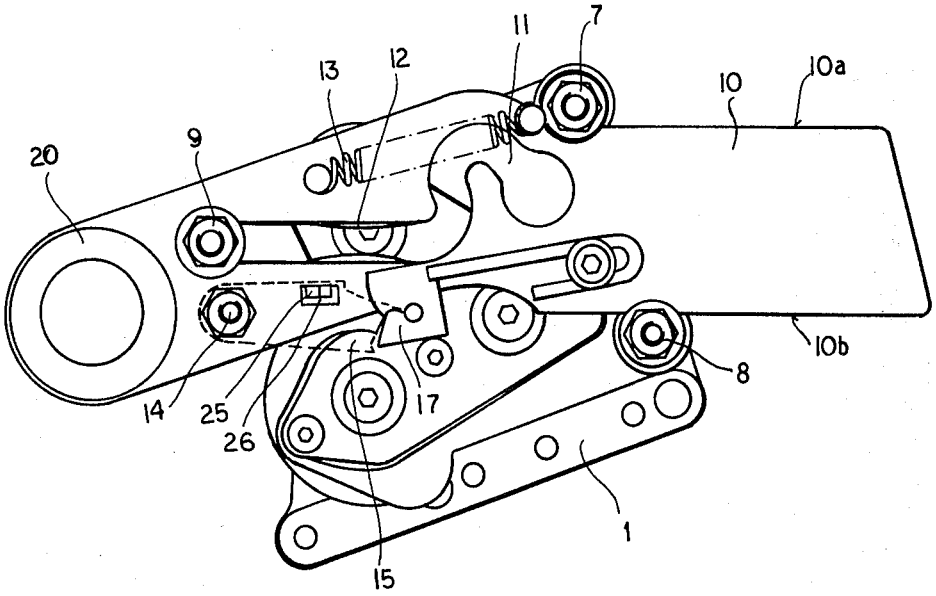
FIGS. 4 and 5 are top views of the apparatus again respectively showing the loading device in the inner and outer positions.
Figure 5:
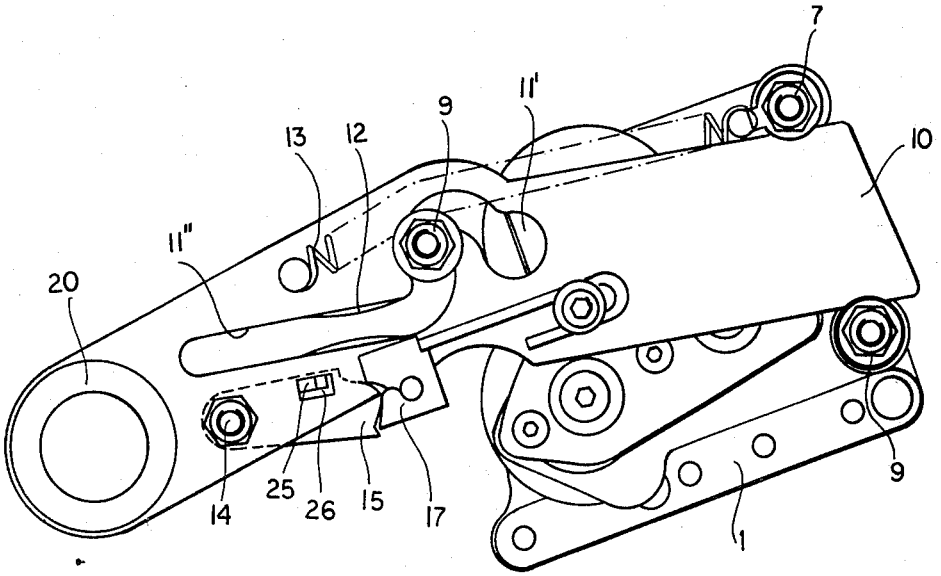
Figure 6:
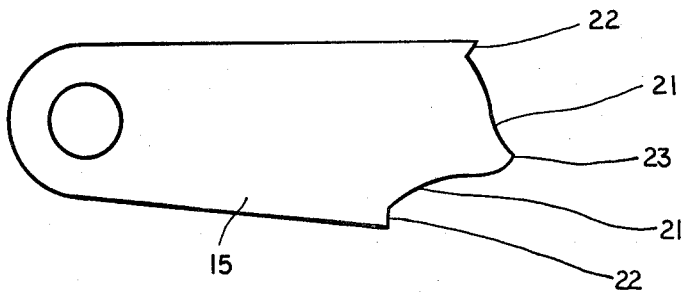
FIG. 6 is a large-scale top view of a loading arm according to this invention.

As seen in FIGS. 4 and 5 the slot 11 is throughgoing and is generally S-shaped. Normally the bolt 9 rides in a straight portion 11″ of this slot 11 for straight-line motion as described above. Thus in use the holder 10 is pulled out and pivoted slightly to the side to engage the top of the tie rod 9 in the central curve part of the S-groove 11 as shown in FIG. 5. In this position the support bar 10 is held stably, even though the spring 13 is tensioned considerably. Once the operator has threaded the new yarn Y through the superposed eyes 16 and 17, he need merely push the holder plate 10 slightly to the side to engage the top of the rod 9 in the end of the straight section 11″ so that the spring 13 will thereafter pull the holder 10 into the inner position shown in FIG. 4. The inner edges at the starting point, going from outer position to inner position, of the groove 11 are formed with inwardly directed braking formations 12 that ensures relatively slow travel from the outer to the inner position. In this manner thread breakage is further avoided.

The far end 11′ of the slot 11 is somewhat wider than the rest of this slot 11. Thus if the device is manipulated so that the head of the nut on the rod 9 is at this widened region 11′, the entire holder 10 can be lifted off the twisting apparatus. Simply unhooking the tension spring 13 from the rod 7 then allows the loading device to be exchanged for another or used on a different apparatus.

Figure 7:
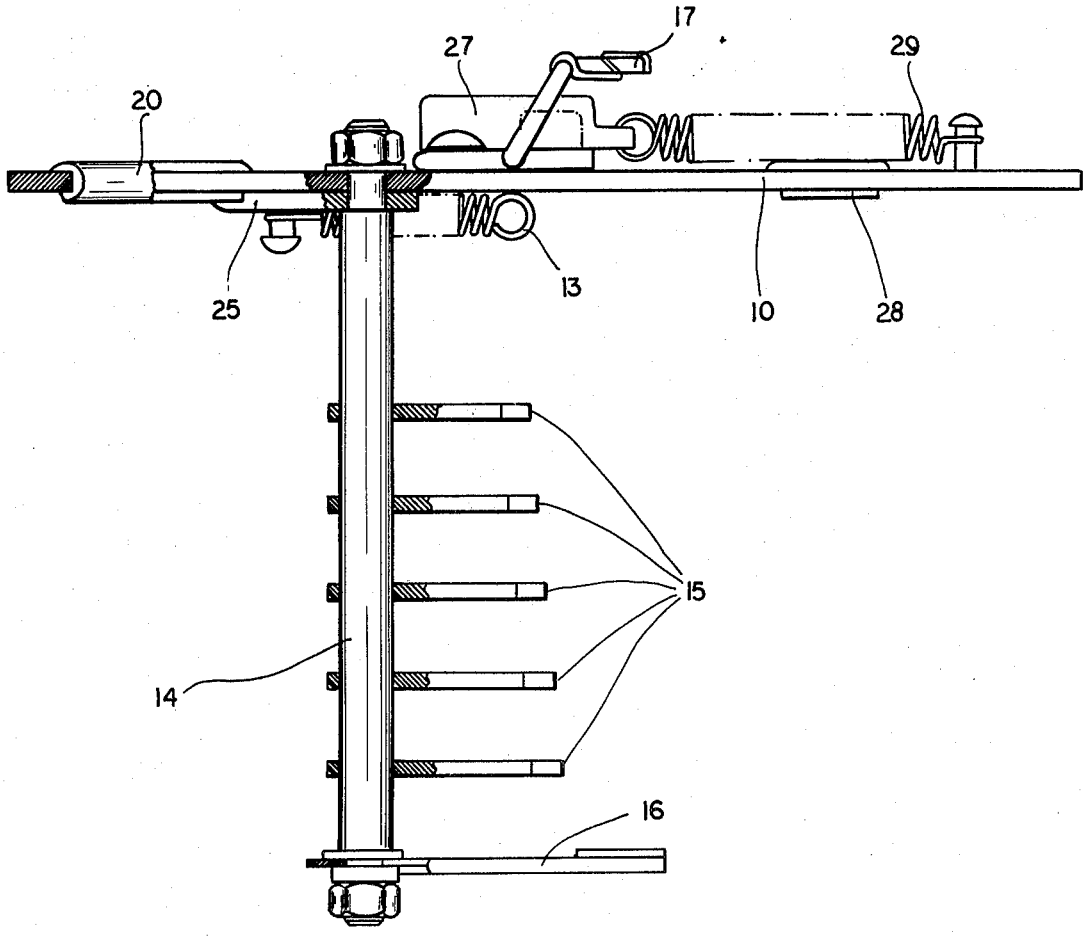
FIGS. 7 and 8 are side and top views, respectively, of another loading device according to this invention.
Figure 8:
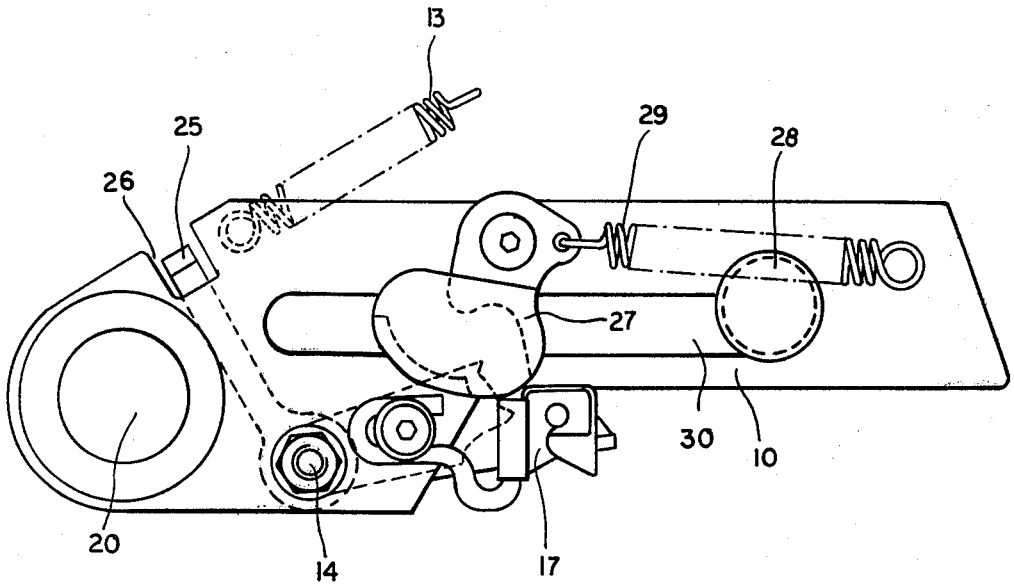

FIGS. 7 and 8 show another arrangement according to this invention, identical reference numerals referring to functionally identical structure. Here, however, the groove 11 is replaced by a groove 30 that is straight, although provided at one end with a widened region comparable to the region 11′ but receiving a cap 28 to prevent accidental disassembly of the arrangement. A pawl 27 rotationally biased by a spring 29 here serves the retaining and braking functions described above.

This arrangement eliminates any pivotal motion of the support plate 10 on the basic twisting apparatus. To operate it the plate 10 is pulled out until it locks on the pawl 27 in the outer position. Once a new yarn Y has been threaded through the eyes 16 and 17 the user need merely give the plate another slight outward pull to release it and allow it to move slowly back past the pawl 27, being braked on the way.

With the apparatus according to the instant invention it is possible to leave the arms 15 engaged in the device during twisting. It is also, of course, possible to provide this arm on an arrangement wherein one of the sets of rollers can be displaced outwardly, although on such an arrangement the standard threading problems are considerably less.

We claim:

1. In combination with a false-twist apparatus including:

a support defining at least three generally parallel and radially spaced axes surrounding a central axially extending twisting region;

respective shafts lying on said axes and journaled in said support for rotation about the respective axes;

respective axially staggered sets of axially spaced disks fixed on said shafts, said disks having rims radially overlapping at said twisting region; and a pair of yarn eyes axially flanking said disks and axially aligned with said twisting region, whereby a yarn to be false-twisted can pass axially through one of said eyes, then zig zag along said region in contact with said disks, and then axially through the other eye;

the improvement comprising:

drive means connected to all of said shafts for permanently connecting same together for joint rotation, whereby a yarn passing through said eyes and said region is false-twisted by the rotating disks;

a holder displaceable in a substantially straight line generally perpendicular to said region toward and away from said region; and a loading arm carried on and jointly displaceable with said holder and having a yarn-pushing tip turned toward said region and engageable between said disks, said tip being displaceable with said arm between an outer position spaced from said disks and an inner position with said tip and a yarn engaged thereover in said region and axially between said disks.

2. The improvement defined in claim 1 wherein said apparatus has a guide on said support and displaceably receiving said holder.

3. The improvement defined in claim 2 wherein said holder carries a plurality of such arms axially spaced from one another, generally axially aligned with one another, and jointly displaceable with said holder.

4. The improvement defined in claim 3 wherein said tips of said arms are offset from one another stepwise in a direction away from said region, whereby a yarn engaged over said tips is pushed stepwise into engagement with said disks.

5. The improvement defined in claim 3 wherein said eyes are carried on and jointly displaceable with said holder.

6. The improvement defined in claim 3 wherein said disks of said sets define respective imaginary cylinders overlapping at said thread-twisting region, said straight line extending as a secant across one of said cylinders and only intersecting all of said cylinders in said region.

7. The improvement defined in claim 6 wherein said tips each have a pair of pusher edges and a projecting point therebetween, said point moving substantially radially of an axis parallel to the axes of said sets and equispaced therebetween on displacement of said arms between said inner and outer positions.

8. The improvement defined in claim 6 wherein said tips each have a pusher edge and an edge projection at the end of said edge.

9. The improvement defined in claim 6 wherein said tips each have a projecting point and a pair of edges flanking said point, one of said edges being generally S-shaped and lying at an angle smaller than 45° to said straight line and the other being generally U-shaped and lying at an angle greater than 45° to said straight line.

10. The improvement defined in claim 6, further comprising means for pivoting said holder and said straight line about a pivot axis parallel to but offset from shafts between an S-twist position extending secantally across one of said cylinders into said region and a Z-twist position extending secantally across another of said cylinders into said region.

11. The improvement defined in claim 6, further comprising means for retaining said holder in said inner and outer positions, and biasing means for urging said holder when between said positions into said inner position.

12. The improvement defined in claim 11, further comprising means for braking the displacement of said holder from said outer to said inner position.

13. The improvement defined in claim 12 wherein said means for breaking and means for retaining include a pivotal spring-loaded pawl on said support engageable with said holder.

14. The improvement defined in claim 6, further comprising means releasably securing said holder on said support, whereby said holder can be used with a plurality of such apparatuses.

15. The improvement defined in claim 6 wherein said holder is formed with a slot, said holder being provided with a pin projecting through said slot and guiding displacement of said holder on said support.

16. The improvement defined in claim 15 wherein said slot is generally S-shaped and has a straight section corresponding to said straight line.

17. The improvement defined in claim 15 wherein said pin has an enlarged head engaging over said holder and holding said holder down on said support, said slot having an enlarged end alignable with said head in an extreme outermost position of said holder for removal of said holder from said support over said pin.

18. The improvement defined in claim 15 wherein said improvement further comprises a spring engaged between said holder and said support and urging said holder into said inner position.

* * * * *